United States Patent [19]

Vidakovits

[11] Patent Number: 4,696,841

[45] Date of Patent: Sep. 29, 1987

[54] HEAT RECOVERABLE TERMINATION DEVICE

[75] Inventor: Lajos J. Vidakovits, Mountain View, Calif.

[73] Assignee: Raychem Corp., Menlo Park, Calif.

[21] Appl. No.: 738,623

[22] Filed: May 28, 1985

[51] Int. Cl.[4] ..... H01R 4/00

[52] U.S. Cl. ..... 428/36; 174/DIG. 8; 174/84 R; 403/273

[58] Field of Search ..... 428/36, 913; 174/84 R, 174/DIG. 8; 403/28, 273

[56] References Cited

U.S. PATENT DOCUMENTS

| | | | |
|---|---|---|---|
| 3,243,211 | 3/1966 | Wetmore | 174/84 R |
| 3,525,799 | 8/1970 | Ellis | 174/84 R |
| 3,582,457 | 6/1971 | Barthell | 174/DIG. 8 |
| 4,271,330 | 6/1981 | Watine et al. | 174/84 R |
| 4,283,596 | 8/1981 | Vidakovits et al. | 174/84 R |
| 4,304,959 | 12/1981 | Vidakovits et al. | 174/84 R |
| 4,376,798 | 3/1983 | Diaz | 403/28 |
| 4,544,802 | 10/1985 | Siden | 174/68.5 |

*Primary Examiner*—John E. Kittle
*Assistant Examiner*—James J. Seidleck
*Attorney, Agent, or Firm*—T. Gene Dillahunty; Herbert G. Burkard; Ira D. Blecker

[57] ABSTRACT

There is disclosed a termination device which includes a dimensionally heat-unstable tubular member and a dimensionally heat-unstable insert. The insert is positioned within the tubular member and is in abutting relationship therewith. The termination device may further include a fusible insert or inserts which may be thermoplastic polymeric materials or solder or both. The dimensionally heat-unstable insert is recoverable and the fusible insert or inserts, if present, are meltable at a temperature used to recover the dimensionally heat-unstable tubular member.

19 Claims, 4 Drawing Figures

HEAT RECOVERABLE TERMINATION DEVICE

FIELD OF THE INVENTION

This invention relates to a heat-recoverable termination device and, more particularly, to a heat-recoverable termination device having a heat-recoverable insert therein for additional strength and wire alignment.

BACKGROUND OF THE INVENTION

In Wetmore U.S. Pat. No. 3,243,211, several types of novel connectors are disclosed. Electrical connectors according to the Wetmore patent, the disclosure of which is incorporated by reference herein, include a dimensionally heat-unstable member such as a sleeve in which is placed a ring or ball-shaped solder insert. In a typical connector of this type, both ends of the member or sleeve are open to receive the electrical conductors that are to be connected. The connector is then heated, causing the member or sleeve to shrink and firmly grip the conductors. The heat also causes the solder to flow and form a soldered connection between the two electrical conductors. The sleeve acts to contain the movement of the solder so that a good soldered joint is assured.

In general, such members or sleeves are made of a material capable of having the property of plastic or elastic memory imparted thereto and are expanded under heat and pressure to a diameter greater than their normal diameter and cooled while under pressure. A sleeve treated in this manner will retain its expanded position until it is again heated to above its heat-recovery temperature at which time it will recover to its original shape. Examples of material useful in forming such dimensionally heat-unstable recoverable members may be found in Currie U.S. Pat. No. 2,027,962 and Cook et al. U.S. Pat. No. 3,086,242, the disclosures of which are incorporated herein by reference. Polymeric materials which have been cross-linked by chemical means or by irradiation, for example, with high-energy electrons or nuclear radiation, such as those disclosed in the Cook et al. patent, are preferred for use in the present invention. Noncrystalline polymeric materials exhibiting the property of plastic or elastic memory, such as polyurethane, inomers, etc, could also be used in practicing the present invention. The connector of the present invention is equally useful with sleeves made from materials having either plastic or elastic memory; consequently, as used herein, the terms "elastic memory" and "plastic memory" are used interchangeably and are intended to be mutually inclusive.

Recoverable members or sleeves of this type are extremely useful in the making of insulated soldered connections between electrical conductors such as between a terminal on a piece of electrical apparatus and a wire, or between two wires. Generally, this is accomplished by providing the recoverable sleeve with an internal ring of solder, pasing the electrical conductors into the two ends of the sleeves until the conductive portions of the conductors are located within the solder ring, and heating the assembly so that the sleeve tries to recover to its original shape and the solder melts and joins the two conductors. The result is a good electrical connection which is insulated and protected by the sleeve.

In Ellis U.S. Pat. No. 3,525,799, which is incorporated herein by reference, there are disclosed fusible inserts, other than solder, for sealing a connector so as to prevent extrusion of the melted solder and also for properly locating a conductor. As disclosed therein, these fusible inserts are generally made from any material that is capable of being rendered flowable by the application of heat. However, preferred materials are thermoplastic materials such as polyolefins, polyamides and polyesters.

It has been found that under certain circumstances the Wetmore and Ellis devices have insufficient mechanical strength to properly maintain alignment of the conductor and, for example, a terminator such as a mass termination connector (MTC) wafer terminator. An MTC wafer terminator is a termination device employed by Raychem Corporation. However, the problem of aligning the conductor and this particular terminator is common to many other types of devices as well. If there is insufficient alignment of the conductor and terminator, it is very likely that a poor electrical connection will result. It would thus be desirable to have a termination device that has sufficient strength to properly align electrical components so as to maintain good electrical contact.

Accordingly, it is an object of the invention to have a termination device with sufficient strength so as to properly align electrical components and maintain good electrical contact.

This and other objects of the invention will become more apparent after reference to the following description, considered in conjunction with the accompanying drawings.

BRIEF SUMMARY OF THE INVENTION

There is disclosed according to the invention a termination device comprising a dimensionally heat unstable tubular member having a wall and a dimensionally heat unstable insert positioned therein in abutting relationship with the wall of the tubular member. The dimensionally heat unstable insert is recoverable at the temperature used to recover the tubular member. It has been found that the performance of the termination device is markedly enhanced by the presence of the dimensionally heat unstable insert which adds mechanical strength to the termination device.

The termination device may additionally comprise a fusible insert or inserts. The fusible insert or inserts may be solder, a thermoplastic polymeric material, or both. It is preferred that the fusible insert or inserts melt or flow at the temperature required to recover the tubular member.

DETAILED DESCRIPTION OF THE INVENTION

According to the invention there is disclosed a termination device comprising a dimensionally heat unstable tubular member having a wall and a dimensionally heat-unstable insert positioned therein and in abutting relationship with the wall of said tubular member. The dimensionally heat unstable insert is recoverable at a temperature used to recover the tubular member.

In another aspect of the invention, there is disclosed according to the invention a termination device comprising a dimensionally heat-unstable tubular member having a wall, a fusible insert, and a dimensionally heat unstable insert. The fusible insert and the dimensionally heat unstable insert are positioned within the tubular member and in abutting relationship with the wall of the tubular member. The fusible insert is meltable and the dimensionally heat unstable insert is recoverable at a tempeature used to recover the tubular member.

In a further aspect of the invention, there is disclosed according to the invention a termination device comprising a dimensionally heat unstable tubular member having a wall, a polymeric fusible insert, a metallic fusible insert, and a dimensionally heat unstable insert. The polymeric fusible insert is positioned proximate to an end of the tubular member and in abutting relationship with the wall of the tubular member. The metallic fusible insert and the dimensionally heat unstable insert are positioned generally centrally within the tubular member and in abutting relationship with the wall of the tubular member. The fusible inserts are meltable and the dimensionally heat unstable insert is recoverable at a temperature used to recover the tubular member.

Figure 1:
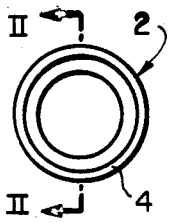
FIG. 1 is an end view of the termination device according to the invention.
Figure 2:
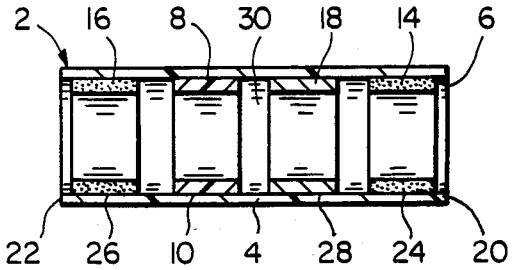
FIG. 2 is a sectional view of the termination device according to the invention in the direction of arrows II—II of FIG. 1.

Referring to the figures in more detail, and particularly referring to FIGS. 1 and 2, there is shown the termination device according to the invention generally indicated by 2. The termination device comprises a dimensionally heat-unstable tubular member 4 having a wall 6. The dimensionally heat unstable insert 8 is positioned within the tubular member and is in abutting relationship 10 with the wall 6 of the tubular member.

As stated in the Background of the Invention, the term dimensionally heat unstable refers to the property of certain materials as having plastic or elastic memory. That is, these materials have a shape which is unstable at higher temperatures so that when these materials are exposed to this higher temperature, called its recovery temperature, these materials will return to their heat-stable shape. These materials are commonly called recoverable materials.

The tubular member and the dimensionally heat-unstable insert each have a predetermined longitudinal dimension. And as can be seen, particularly in FIG. 2, the longitudinal dimension of the tubular member is substantially larger than the longitudinal dimension of the insert.

The termination device may also include at least one fusible insert. The fusible insert (or inserts) is positioned within the tubular member and in abutting relationship with the wall of the tubular member. The fusible insert (or inserts) is meltable at the temperature used to recover the tubular member. The fusible insert (or inserts) may be made from a thermoplastic polymeric material or solder. If there is only one fusible insert, it will preferably be solder; however, it is also within the scope of the invention for the one fusible insert to be a thermoplastic polymeric material. Normally, however, there will be more than one fusible insert. In this case, the fusible inserts will include a single solder insert for ensuring good electrical contact and at least one, and usually two, inserts of the thermoplastic polymeric material for providing sealing.

The most preferred embodiment of the invention is illustrated in FIG. 2. The thermoplastic polymeric inserts 14, 16 are positioned proximate to an end 20, 22, respectively, of the tubular member. The thermoplastic polymeric inserts are in abutting relationship 24, 26, respectively, with the wall of the tubular member. The metallic fusible insert 18 (the solder) and the dimensionally heat-unstable insert 8 are positioned generally centrally within the tubular member indicated by 30 and in abutting relationship 28, 10, respectively, with the wall of the tubular member. It should be understood that the dimensionally heat-unstable insert and the solder do not need to be exactly centered within the termination device but only within the central portion as encompassed by the polymeric inserts.

It is preferred that the dimensionally heat-unstable insert be made from a polymeric material. The preferred polymeric materials are poly(aryl ether ketone) or ultra high molecular weight polyethylene (UHMWPE) having a molecular weight greater than about 3,000,000.

Poly(aryl ether ketones) suitable for use in this invention have the repeat unit of the formula:

—CO—Ar—CO—Ar'— wherein Ar and Ar' are aromatic moieties at least one of which contains a diaryl ether linkage forming part of the polymer backbone and wherein both Ar and Ar' are covalently linked to the carbonyl groups through aromatic carbon atoms.

Preferably, Ar and Ar' are independently selected from substituted and unsubstituted phenylene and substituted and unsubstituted polynuclear aromatic moieties. The term polynuclear aromatic moieites is used to mean aromatic moieties containing at least two aromatic rings. The rings can be fused, joined by a direct bond or by a linking group. Such linking groups include for example, carbonyl, ether sulfone, sulfide, amide, imide, azo, alkylene, perfluoroalkylene and the like. As mentioned above, at least one of Ar and Ar' contains a diaryl ether linkage.

The phenylene and polynuclear aromatic moieties can contain substituents on the aromatic rings. These substituents should not inhibit or otherwise interfere with the polymerization reaction to any significant extent. Such substituents include, for example, phenyl, halogen, nitro, cyano, alkyl, 2-alkynyl and the like.

Poly(aryl ether ketones) having the following repeat units (the simplest repeat unit being designated for a given polymer) are preferred:

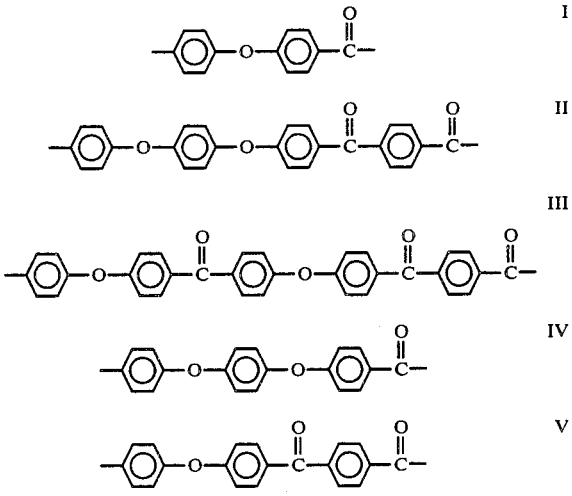

-continued

VI

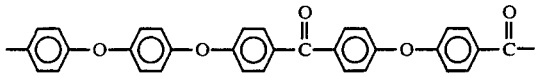

Poly(aryl ether ketones) can be prepared by known methods of synthesis. Preferred poly(aryl ether ketones) can be prepared by Friedel-Crafts polymerization of a monomer system comprising:

(I) (i) phosgene or an aromatic diacid dihalide together with (ii) a polynuclear aromatic comonomer comprising:

(a) H—Ar—O—Ar—H (b) H—(Ar—O)$_n$—Ar—H wherein n is 2 or 3

(c) H—Ar—O—Ar—(CO—Ar—O—Ar)$_m$—H wherein m is 1, 2 or 3 or (II) an acid halide of the formula:

H—Ar''—O—[(Ar''—CO)$_p$—(Ar''—O)$_q$(AR'-'—CO)$_r$]$_k$—Ar''—CO—Z wherein Z is halogen, k is 0, 1 or 2, p is 1 or 2, q is 0, 1 or 2 and r is 0, 1 or 2;

or (III) an acid halide of the formula:

H—(Ar''—O)$_n$—Ar''—Y wherein n is 2 or 3 and Y is CO—Z or CO—Ar'-'—CO—Z where Z is halogen;

wherein each Ar'' is independently selected from substituted or unsubstituted phenylene, and substituted and unsubstituted polynuclear aromatic moieties free of ketone carbonyl or ether oxygen groups, in the presence of a reaction medium comprising:

(A) A Lewis acid in an amount of one equivalent per equivalent of carbonyl groups present, plus one equivalent per equivalent of Lewis base, plus an amount effective to act as a catalyst for the polymerization;

(B) a Lewis base in an amount from 0 to about 4 equivalents per equivalent of acid halide groups present in the monomer system;

(C) a non-protic diluent in an amount from 0 to about 93% by weight, based on the weight of the total reaction mixture.

The aromatic diacid dihalide employed is preferably a dichloride or dibromide. Illustrative diacid dihalides which can be used include, for example

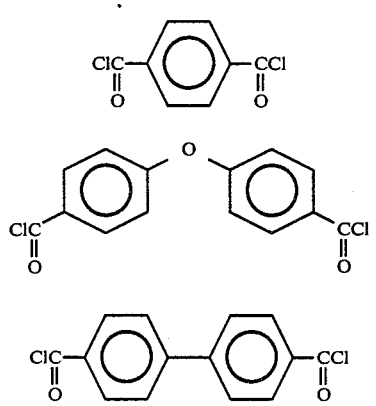

-continued

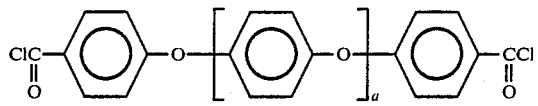

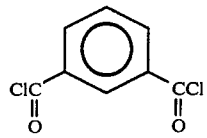

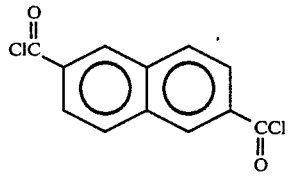

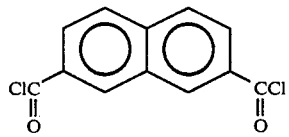

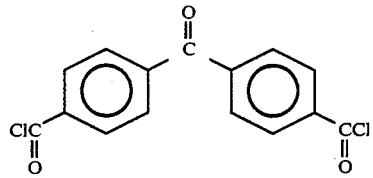

wherein a is 0–4.

Illustrated polynuclear aromatic comonomers which can be used with such diacid halides are:

(a) H—Ar''—O—Ar''—H, which includes, for example:

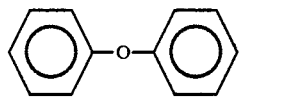

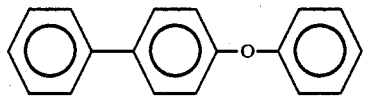

(b) H—(Ar''—O)$_n$—Ar''—H, which include, for example:

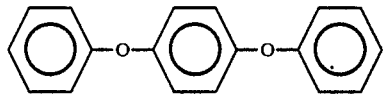

and

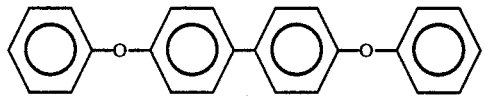

(c) H—Ar''—O—Ar''—(CO—Ar''—O—Ar'')$_m$—H, which includes, for example:

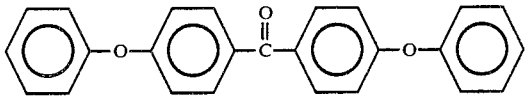

and (d) $H—(Ar''—O)_n—Ar''—CO—Ar''—(O—Ar'')_m—H$ which includes, for example:

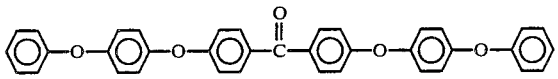

Monomer systems II and III comprise an acid halide. (The term acid halide is used herein to refer to a mono-acid monohalide.) In monomer system II, the acid halide is of the formula:

$H—Ar''—O—[(Ar''—CO)_p—(Ar''—O)_q—(Ar''—CO)_r]_k—Ar''—CO—Z$

Such monomers include for example, where k=0

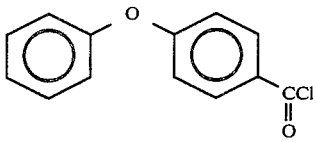

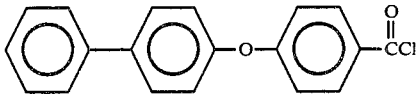

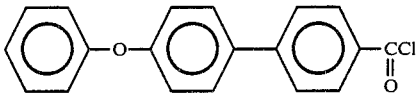

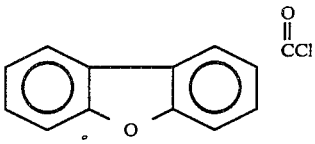

and where k=1

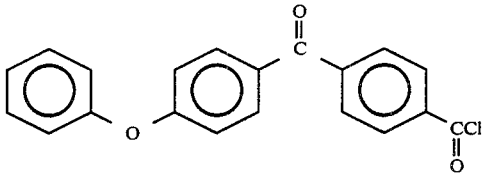

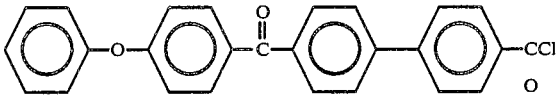

In monomer system III, the acid halide is of the formula $H—(Ar''—O)_n—Ar''—Y$

Examples of such acid halides include

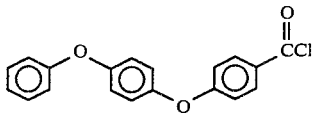

and

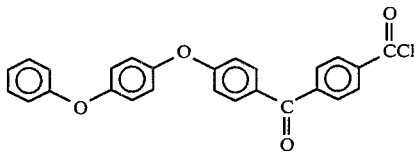

It is to be understood that combinations of monomers can be employed. For example, one or more diacid dihalides can be used with one or more polynuclear aromatic comonomers as long as the correct stoichiometry is maintained. Further, one or more acid halides can be included. In addition monomers which contain other linkages such as those specified above, can be employed as long a one or more of the comonomers used contains at least one ether oxygen linkage. Such comonomers include for example:

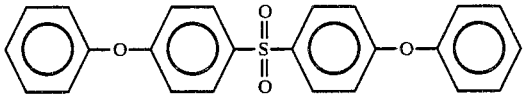

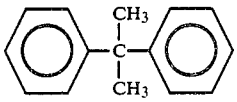

which can be used as the sole comonomer with an ether containing diacid dihalide or with phosgene or any diacid dihalide when used in addition to a polynuclear aromatic comonomer as defined in I(ii)(a), I(ii)(b), I(ii)(c) or I(ii)(d). Similarly

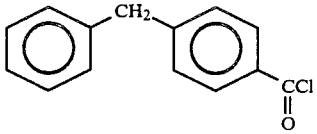

can be used as a comonomer together with an ether-containing polynuclear aromatic acid halide or as an additional comonomer together with a monomer system as defined in I.

The monomer system can also contain up to about 30 mole % of a comonomer such as a sulfonyl chloride which polymerizes under Friedel-Crafts conditions to provide ketone/sulfone copolymers.

Further details of this process for producing poly(aryl ether ketones) can be found in commonly assigned co-pending U.S. application Ser. No. 594,503, filed Mar. 31, 1984, the disclosure of which is incorporated herein by reference.

Other processes for preparing these polymers can be found in U.S. Pat. Nos. 3,953,400, 3,956,240, 3,928,295, 4,108,837, 4,176,222 and 4,320,224.

The ultra high molecular weight polyethylenes suitable for use in this invention are disclosed in U.S. patent application Ser. No. 582,105 filed Feb. 21, 1984 entitled "Recoverable Polyethylene Composition and Article," which is incorporated herein by reference.

In an alternative preferred embodiment, the dimensionally heat-unstable insert may comprise either poly(aryl ether ketone) or UHMWPE loaded with tin. Another preferred embodiment is for the dimensionally heat-unstable insert to comprise either poly(aryl ether ketone) or UHMWPE with a layer of tin or solder on a surface of the material which is not in abutting relationship with the wall of the tubular member. That is, referring to FIG. 2, the dimensionally heat-unstable insert 8 may have a layer of tin or solder on surface 12 which faces toward the interior of the termination device and also faces in the direction of recovery of the termination device. When the dimensionally heat unstable insert contains tin or is plated with tin or solder, it is expected that the insert will be at least partially fusible. However, the insert will nevertheless retain its property of being dimensionally heat unstable.

It is also contemplated within the scope of the invention that when the dimensionally heat-unstable insert contains tin or is plated with tin or solder, the dimensionally heat-unstable insert simultaneously provides the compressive force necessary to hold the electrical contacts together while also fusing the electrical contacts, thereby providing a good electrical connection so that a separate solder insert may become unnecessary.

Figure 3:
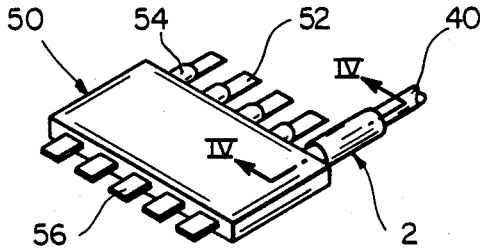
FIG. 3 is a perspective view of the termination device according to the invention in a proposed method of use.
Figure 4:
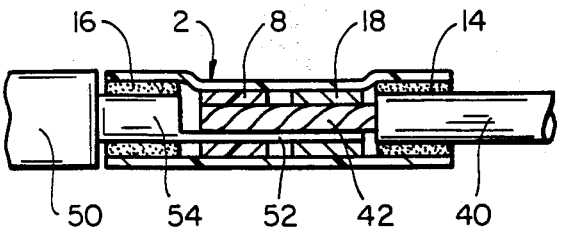
FIG. 4 is a cross-sectional view of the termination device according to the invention in the direction of arrows IV—IV of FIG. 3.

Referring now to FIG. 3, there is shown the termination device used in one proposed environment. As shown in the figure, it is desired to join a wire 40 and an MTC wafer terminator 50. The wafer has tabs 52, a slightly enlarged portion 54 and electrical contacts 56. The problem in the past has always been to properly align the stripped portion 42 of the wire 40 with the tab 52 of the wafer 50. When the stripped portion of the wire and the tab are not properly aligned, there is, of course, improper electrical connection. As shown in FIG. 4, the recovered termination device 2 has properly located the stripped portion 42 of the wire onto the tab 52. The dimensionally heat-unstable insert provides the mechanical strength necessary to hold the stripped portion of the wire to the tab while the metallic fusible insert fuses an provides the required electrical connection between the stripped portion of the wire and the wafer tab. Polymeric fusible inserts 14, 16 complete the termination by sealing the ends of the termination device so as to provide an environmentally secure termination device as well as to prevent the solder from squeezing out through the ends. As stated before, it is possible that when the dimensionally heat unstable insert is loaded with tin or is plated with tin or solder, the fusible insert may possibly be dispensed with, if desired.

TEST RESULTS

Tests were performed to determine the mechanical strength of a presently used termination device and termination devices prepared according to the invention. The presently used termination device included a dimensionally heat unstable tubular member, polymeric fusible inserts at either end of the tubular member, and a solder insert near the center of the tubular member. This termination device is similar to the termination device shown in FIG. 2 except this termination device did not include the dimensionally heat-unstable insert 8. Against this termination device, termination devices according to the invention were prepared which did include the dimensionally heat unstable insert. In the termination devices according to the invention, the dimensionally heat-unstable insert was either made from a poly(aryl ether ketone) or an ultra high molecular weight polyethylene.

The termination devices were further prepared by inserting electrical conductors in either end of the termination device so as to form an electrical connection. Several termination devices of each type were prepared in this manner. The terminated termination devices were then placed in an Instron Tensile Testing Machine and the electrical conductors pulled so as to determine the tensile strength of each termination device.

The presently used termination device had a tensile strength which varied over several samples from zero to 34 pounds. The termination device according to the invention, having the dimensionally heat-unstable insert which was made of the poly(aryl ether ketone), had a tensile strength which was consistently in the range of $33\frac{1}{2}$ to 35 pounds. The other termination device according to the invention, which had a dimensionally heat-unstable insert made from ultra high molecular weight polyethylene had a tensile strength which was consistently in the range of $39\frac{1}{2}$ to $40\frac{1}{2}$ pounds.

Thus, it can be appreciated that the termination devices according to the invention, containing a dimensionally heat-unstable insert made from either poly(aryl ether ketone) or ultra high molecular weight polyethylene, exhibited superior mechanical strength and clearly out-performed the presently used termination device.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

I claim:

1. A termination device comprising:

a dimensionally heat-unstable tubular member having a wall, a fusible insert and a dimensionally heat-unstable insert;

wherein dimensionally heat-unstable refers to said tubular member and said heat-unstable insert having plastic or elastic memory which defines the property of certain materials as being unstable at higher temperatures so that when the materials are exposed to this higher temperature, the materials return to their heat-stable shape;

said fusible insert and said dimensionally heat-unstable insert positioned within said tubular member and in abutting relationship with the wall of said tubular member;

said fusible insert being meltable and said dimensionally heat-unstable insert being recoverable at a temperature used to recover said tubular member.

2. The termination device of claim 1 wherein the dimensionally heat-unstable insert comprises a poly(aryl ether ketone).

3. The termination device of claim 2 wherein the poly(aryl ether ketone) is poly(p-carbonyl-phenylene-p-oxyphenylene).

4. The termination device of claim 2 wherein the poly(aryl ether ketone) is poly(p-carbonyl-phenylene-p-oxyphenylene-p-oxy-phenylene).

5. The termination device of claim 1 wherein the dimensionally heat-unstable insert comprises ultra high molecular weight polyethylene having a molecular weight greater than about 3 million.

6. The termination device of claim 1 wherein the fusible insert comprises a thermoplastic polymeric material.

7. The termination device of claim 1 wherein the fusible insert comprises solder.

8. The termination device of claim 1 wherein the dimensionally heat-unstable insert comprises a polymeric material loaded with tin.

9. The termination device of claim 1 wherein the dimensionally heat-unstable insert comprises a polymeric material having a layer of tin on a surface which is not in abutting relationship with the wall of said tubular member.

10. The termination device of claim 1 wherein the dimensionally heat-unstable insert comprises a polymeric material having a layer of solder on a surface which is not in abutting relationship with the wall of said tubular member.

11. A termination device comprising:

a dimensionally heat-unstable tubular member having a wall, a polymeric fusible insert, a metallic fusible insert, and a dimensionally heat-unstable insert;

wherein dimensionally heat-unstable refers to said tubular member and said heat-unstable insert having plastic or elastic memory which defines the property of certain materials as being unstable at higher temperatures so that when the materials are exposed to this higher temperature, the materials return to their heat-stable shape;

said polymeric fusible insert positioned proximate to an end of said tubular member and in abutting relationship with the wall of said tubular member;

said metallic fusible insert and said dimensionally heat-unstable insert positioned generally centrally within said tubular member and in abutting relationship with the wall of said tubular member;

said fusible inserts being meltable and said dimensionally heat-unstable insert being recoverable at a temperature used to recover said tubular member.

12. The termination device of claim 11 wherein the dimensionally heat-unstable insert comprises a poly(aryl ether ketone).

13. The termination device of claim 12 wherein the poly(aryl ether ketone) is poly(p-carbonyl-phenylene-p-oxyphenylene).

14. The termination device of claim 12 wherein the poly(aryl ether ketone) is poly(p-carbonyl-phenylene-p-oxyphenylene-p-oxy-phenylene).

15. The termination device of claim 11 wherein the dimensionally heat-unstable insert comprises ultra high molecular weight polyethylene having a molecular weight greater than about 3 million.

16. The termination device of claim 11 wherein the polymeric fusible insert comprises a thermoplastic polymeric material and the metallic fusible insert comprises solder.

17. The termination device of claim 11 wherein the dimensionally heat-unstable insert comprises a polymeric material loaded with tin.

18. The termination device of claim 11 wherein the dimensionally heat-unstable insert comprises a polymeric material having a layer of tin on a surface which is not in abutting relationship with the wall of said tubular member.

19. The termination device of claim 11 wherein the dimensionally heat-unstable insert comprises a polymeric material having a layer of solder on a surface which is not in abutting relationship with the wall of said tubular member.

* * * * *